United States Patent [19]

Lapke et al.

[11] Patent Number: 4,559,421

[45] Date of Patent: Dec. 17, 1985

[54] ELECTRICAL CONNECTOR INCLUDING A MAKE-BEFORE-BREAK SWITCH ARRANGEMENT

[75] Inventors: James A. Lapke, Shelton; Carl W. Schmelzle, Westport, both of Conn.

[73] Assignee: Allied Corporation, Morristown, N.J.

[21] Appl. No.: 586,470

[22] Filed: Mar. 5, 1984

[51] Int. Cl.[4] ..... H01R 33/30

[52] U.S. Cl. ..... 200/51.1; 200/2; 200/153 S; 339/154 A

[58] Field of Search ..... 200/51.11, 51.10, 51.09, 200/153 S, 2; 339/151 C, 151 M, 154 R, 154 A, 157 R

[56] References Cited

U.S. PATENT DOCUMENTS 2,924,677 2/1960 Lanctot ..... 200/153 S 4,439,303 3/1984 Astier ..... 200/51.1

*Primary Examiner*—Stephen Marcus
*Assistant Examiner*—Renee S. Kidorf
*Attorney, Agent, or Firm*—C. D. Lacina

[57] ABSTRACT

A circuit breaker connector (100) for joining the ends of a pair of cables (10, 20) and passing an electrical signal therethrough, including a contact arrangement comprising an input contact (38) and an output contact (44) electrically connected to an internal switch contact (70) with the contacts cooperating to define a first electrical circuit path, and make-before-break switch means (72, 60) allowing insertion of an external circuit element (90) without interrupting the first circuit path for completing a second electrical circuit path including the circuit element (90) before breaking the first electrical circuit path.

6 Claims, 4 Drawing Figures

CIRCUIT ELEMENT
OUT PUT
INPUT

CIRCUIT
OUTPUT
INPUT

ELECTRICAL CONNECTOR INCLUDING A MAKE-BEFORE-BREAK SWITCH ARRANGEMENT

This invention relates to a circuit breaker connector for joining ends of a transmission line comprising a pair of coaxial cables to transmit an electrical signal therethrough which allows the insertion of an external circuit element into the line without opening the line and interrupting transmission of the signal therethrough.

In many radio frequency (RF) and data transmission line systems, when a device is either inserted or removed into the line, this action will adversely affect the remainder of the system. Further in some of these systems, a source transmission line cannot be left unterminated.

Accordingly, it would be desirable to have a connector device which allows either insertion or removal of an apparatus or circuit element from a transmission line system without affecting the balance of the system or transmission of an electrical signal therethrough.

In accord with this invention, a circuit breaker connector is adapted to electrically connect a pair of cables for transmitting an electrical signal, the connector including a pair of contact members with each contact member connecting to one of the cables, transmitting means connected to the contact members and defining a first electrical circuit path for transmitting the electrical signal between the contact members, and a make-before-break switch means for inserting a circuit element into a second electrical circuit path before breaking the first electrical circuit path and without interrupting the transmission of the signal between the cables. The circuit element could provide any desired electrical impedance to the system, alternate the routing of the signal, or allow entry of data.

An advantage of the present connector is an apparatus which allows for subsequent addition or deletion of circuit elements from a transmission line without interrupting transmission of electrical signals through the line.

One way of carrying out the invention is described in detail below with reference to the drawings which illustrate a specific embodiment of this invention, in which.

Figures 1, 2, 3, 4:
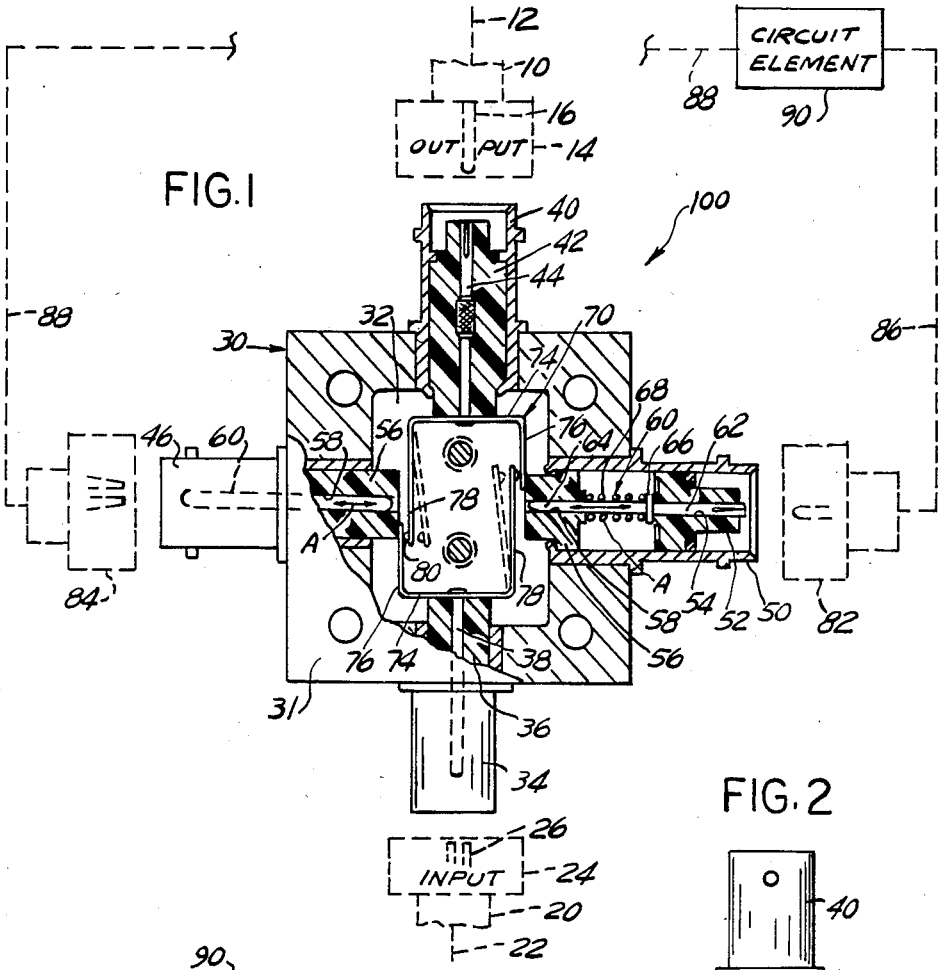
FIG. 1 is a plan view of a connector in partial cross-section and partially cut-away to show interior detail.
FIG. 2 is a side view, partially in section, taken along lines II—II of FIG. 1.
FIGS. 3 and 4 show schematic views of the operation of the connector.

Referring now to the drawings, FIG. 1 shows a circuit breaker connector assembly 100 for joining the ends of a first pair of cables 10, 20 which define a transmission line for transmitting an electrical signal, the assembly including a contact arrangement for completing a first electrical circuit path and a second electrical circuit path for inserting an external circuit element into the transmission line without interrupting transmission of the electrical signal between cables.

Although shown in phantom, each cable 10, 20 has, respectively, a center conductor 12, 22 and its free end terminated by a mateable connector shell 14, 24, each connector shell being mateable with one another and including, respectively, a contact element 16, 26 disposed in electrical isolation thereto and electrically connected to its respective center conductor, the contact elements 16, 26 being shown, respectively, as having a socket-type end and a pin-type end for mating.

The circuit breaker connector assembly 100 comprises an enclosure 30 defining an interior cavity 32, an input connector 34 including a dielectric insert 36 rigidly mounted therein and an input contact 38 fixedly secured in the insert, an output connector 40 including a dielectric insert 42 rigidly mounted therein and an output contact 44 fixedly secured in the insert, and an internal switch contact 70 received in the cavity 32 and electrically connected to both input contact 38 and output contact 44, the input and output connectors 34, 40 being mounted on the enclosure 30 and adapted to mate, respectively, with the mateable connector shells 24, 14.

An output shunt connector 46 and an input shunt connector 50 are also mounted on the enclosure 30, the shunt connectors being configured, respectively, for connection to a mating connector 84, 82 and each including in electrical isolation to the enclosure an electrically conductive pin-like shunt contact 60 with each shunt contact being adapted to move from a first position to a second position as a result of the respective shunt connector being unconnected or connected during mating with its compatible connector 82, 84, the first and second positions resulting in the shunt contact, respectively, either being not in contact with the internal switch contact or in contact with the internal switch contact.

The input and output shunt connectors 50, 46 are identical and only one will be described here. Input shunt connector 50 fixedly mounts a forward sleeve 52 and a rearward sleeve 56 in spaced relation with each sleeve being comprised of dielectric material and having, respectively, an axial bore 54, 58 extending therethrough, the rearward sleeve 56 having its axial bore 58 communicating with the interior cavity 32. Shunt contact 60 is an axially elongated shaft which includes a forward contact portion 62, a rearward contact portion 64, and an intermediate shoulder 66, the forward and rearward contact portions 62, 64 being slidably mounted, respectively, in the bores 54, 58 of its respective dielectric sleeve 52, 56 for reciprocating movement in the direction indicated by the arrow designated at "A". A coil spring 68 is fit about the shunt contact such that one end of the coil is abutted against the rearward sleeve 56 and the other end of the coil is abutted against the shoulder 66 so as to normally bias the shunt contact 60 axially outward from the cavity and into abutment against the forward sleeve 52.

Internal switch contact 70 comprises a pair of generally U-shaped contactors 72 of electrically conductive material with each contactor being identical and comprising a central bight 74, a first leg 76 and a second leg 78, each of the legs 76, 78 being of unequal length and extending from the bight 74, the bight 74 of one contactor being connected to input contact 38 and the bight of the other contactor being connected to output contact 44. As shown, each of the first legs 76 are shorter than each of the second legs 78 with each contactor having its first leg 76 being abutted against one of the rearward sleeves 56 and its second leg 78 being abutted against the first leg 76 of the other contactor. The second legs 78 describe cantilever-type beams with each beam being aligned with one or the other bore 58 and with the shunt contact 60 disposed therein and each including at its deflectable end a raised contact portion 80 having a V-shaped cross-section for bearing against the surface of its associated first leg 76.

The second legs 78 are normally biased against the first legs 76 and each second leg is adapted to be driven inwardly into interior cavity 32 by its associated shunt contact 60 as a result of connection of shunt connectors 46, 50 to the compatible mating connectors 82, 84. During such mating, each of the shunt contacts 60 overcome the outward bias of coil springs 68 and each is driven axially inward into the cavity 32 and against the second legs 78 to deflect each second leg 78 from contact with each first leg 76. The deflection of each second leg is shown by the dotted lines.

An electrical circuit path is completed between a circuit element 90, the pair of mating connectors 82, 84, and a pair of cables 86, 88 having, respectively, one and the other of its ends terminated in electrical circuit relation to the circuit element and the mating connector 82, 84. Circuit element 90 could comprise an electrical means for modifying the electrical circuit impedance through the cables. The electrical means could be a resistor, an electrical circuit or some other electrical apparatus.

FIG. 2 shows interior cavity 32 of enclosure 30 and one of the second legs 78 in contact with its associated first leg 76, each of the legs comprising flat blades. A lid 31 encloses cavity 32 of enclosure 30.

FIG. 3 shows, in schematic, connector assembly 100, electrically joined to the first pair of cables 10, 20 whereby an electrical signal may pass therethrough. The circuit element 90, shown in phantom, is not connected. Input connector 34 and mating connector 24 and output connector 40 and mating connector 14 are connected whereby the associated input contacts 26, 38, output contacts 16, 44, and internal switch contact 70 represent a normally closed first electrical circuit path for transmitting the electrical signal. Such a first electrical circuit path, shown by the arrows, would be a-b-d and a-c-d. When inserting the external circuit element, electrical connections are made between the mating connectors 84, 86 with shunt connectors 46, 50, in any order. The first connection breaks one internal circuit but normal transmission through the cable continues without interruption. The second connection breaks the first electrical circuit path and completes a second electrical circuit path through the circuit element. For example, a first connection between mating connector 84 with shunt connector 46 or mating connector 82 with shunt connector 50, respectively, will not disturb transmission of the signal between cables 10, 20 along a-b-d and along a-c-d.

FIG. 4 shows insertion of the circuit element 90 into the transmission path. The second electrical circuit path, which includes the circuit element, is a-e-f-g-h-d. Disconnection of either or both mating connectors 82, 84 from their respective shunt connectors 46, 50 results in automatic uninterrupted return of signal transmission between the cables along the first electrical circuit path.

The circuit element could be a resistor, a data entry station, or an alternate routing for an electrical signal.

We claim:

1. An electrical connector, characterized by an enclosure, a first and a second contact member comprised of electrically conductive material mounted to said enclosure in electrical isolation thereto, transmitting means connected to said contact members and defining a first electrical circuit path for transmitting an electrical signal between the contact members, and make-before-break switch means for making a second electrical circuit path between said contact members before breaking said first electrical circuit path, said transmitting means comprising a first contactor secured to the first contact member and a second contactor secured to the second contact member, each of said contactors being comprised of electrically conductive material and including a first leg and a second leg, the first leg and the second leg of one of said contactor being in electrical circuit relation, respectively, with the second leg and the first leg of the other said contactor, each said second leg being normally biased against its associated first leg and adapted to move from a contacting first position completing the first electrical circuit path to a non-contacting second position completing the second electrical circuit path.

2. The connector as recited in claim 1 wherein said make-before-break switch means inserts a circuit element in said second circuit path for effecting the electrical impedance of the electrical signal transmitted through the contacts and contactors.

3. The connector as recited in claim 1 wherein said make-before-break switch means includes a pair of shunt contacts of electrically conductive material with each said shunt contact being associated with only one said contactor and mounted in electrical isolation to the enclosure for reciprocating motion from an unmated position in electrical isolation to its respective one said contactor and defining the first electrical circuit path and to a mated position in electrical circuit relation to its respective one said contactor and making the second electrical circuit path, the reciprocating movement driving each said shunt contact against the associated second leg to separate the second legs from contact with the associated first legs to thereby break the first electrical circuit path.

4. The connector as recited in claim 3 including a pair of first connector members and a pair of second connector members, each said first connector member being adapted to mate with a compatible connector and each including one said first and second contact member, and each said second connector member being mounted on said enclosure for mating with a compatible connector and each including one said shunt contact.

5. The connector as recited in claim 1 wherein each said contactor is generally U-shaped and comprises a bight and the first and second legs thereof extend from the bight, each said bight being connected to one respective contact member and the legs of each respective pair being of unequal length, the second leg of each said contactor including a contact point and normally biasing the point against the first leg of the other contactor, each said second leg being adapted to deflect from contact with the first leg of the other contactor as a result of one said shunt contact reciprocating thereagainst.

6. The connector as recited in claim 5 wherein each said second connector member comprises: a shell of electrically conductive material, a forward and a rearward insert of dielectric material mounted in said shell in spaced relation with each insert having a bore extending axially therethrough for slidably mounting the shunt contact, each said shunt contact including a first contact portion disposed in the forward insert, a second portion disposed in the rearward insert, and a medial shoulder disposed between the contact portions, and further including bias means interposed between the inserts for normally biasing the medial shoulder outwardly from contacting relation with its respective contactor, mating of said second connector members with their compatible connectors causing said shunt contacts to be driven inwardly and against their associated contactors to break the first electrical circuit path and make the second electrical circuit path.

* * * * *